US012135038B1

(12) United States Patent
Hable et al.

(10) Patent No.: US 12,135,038 B1
(45) Date of Patent: Nov. 5, 2024

(54) CENTRIFUGAL PUMPS AND CASINGS THEREFORE

(71) Applicant: W.S. Darley & Co., Itasca, IL (US)

(72) Inventors: Wayne Hable, Chippewa Falls, WI (US); Shane Sullivan, Chippewa Falls, WI (US); Paul Schaus, Chippewa Falls, WI (US); Sheldon Susa, Chippewa Falls, WI (US)

(73) Assignee: W.S. Darley & Co., Itasca, IL (US)

( * ) Notice: Subject to any disclaimer, the term of this patent is extended or adjusted under 35 U.S.C. 154(b) by 0 days.

(21) Appl. No.: 17/868,426

(22) Filed: Jul. 19, 2022

(51) Int. Cl.
*F04D 29/42* (2006.01)
*F04D 1/00* (2006.01)
*F04D 29/44* (2006.01)

(52) U.S. Cl.
CPC ..... *F04D 29/4293* (2013.01); *F04D 1/00* (2013.01); *F04D 29/445* (2013.01)

(58) Field of Classification Search
CPC .. F04D 29/4293; F04D 29/445; F04D 29/426; F04D 29/428; F04D 29/4286; F04D 1/00
See application file for complete search history.

(56) References Cited

U.S. PATENT DOCUMENTS 2,291,760 A * 8/1942 Rupp ..... F04D 9/005 415/56.6
2,341,871 A * 2/1944 Karrer ..... F04D 29/441 415/206
3,289,598 A * 12/1966 Frederic ..... F04D 29/445 415/211.1
5,141,390 A * 8/1992 Haentjens ..... F04D 15/0022 415/206
7,517,186 B2 * 4/2009 Seitz ..... F04D 29/426 415/206
2006/0165523 A1 * 7/2006 Rozario ..... F04D 29/126 415/206

OTHER PUBLICATIONS

Val S. Lobanoff and Robert R. Ross, Centrifugal Pumps Design & Application, Second Edition, cover and pp. IV, 28-37 and 56-63, 1992, Butterworth-Heinemann, An imprint of Elsevier, United Kingdom.

* cited by examiner

*Primary Examiner* — Brian P Wolcott
*Assistant Examiner* — Jesse M Prager
(74) *Attorney, Agent, or Firm* — Anthony J. Bourget

(57) ABSTRACT

Single suction centrifugal pumps, pump casings, pump systems and vehicles for using pumps which include a single piece casing having a first cut-water wall and a second cut-water wall, corresponding joint-water paths communicating with respective discharge nozzles, the second cut-water wall spanning less than 180 degrees from a leading edge of the second cut-water wall to a trailing edge of the second cute-water wall, and in aspects, the discharge nozzles are offset from a horizontal centerline of a center opening of the casing, the cut-water walls define a diameter which is greater than 1.07 times the impeller diameter, and the diameter is constant for a portion of the walls and transitions to a varying diameter at trailing ends of the walls.

32 Claims, 13 Drawing Sheets

CENTRIFUGAL PUMPS AND CASINGS THEREFORE

BACKGROUND OF THE INVENTION

Centrifugal pumps have been commonplace for ages and have been used in numerous applications. A relatively recent development has been a powerful firefighting type of pump allowing discharge at opposite ends of the pump, such as that found in Seitz et al. U.S. Pat. No. 7,517,186. Such pumps are useful in many cases, including within a firetruck apparatus, especially for discharging a large volume of water over a short time span. Dispensing from different sides of the apparatus allows for flexibility on where the firetruck may be positioned. Such pumps often displace 1500 to 2500 gallons of water or fluid per minute. While operating at such high volumes, the pumps run efficiently and at minimal or acceptable levels of noise. Such high volume powerful pumps are often used for extinguishing major fires, where large volumes of fluid are displaced quickly and over far distances. In some instances, however, a firetruck apparatus may be called to respond to a scene where a relatively small volume of water or fluid is needed. The apparatus may be called to extinguish a dumpster fire or automobile fire, for instance, which typically require minor amounts of water, such as 50 to 100 gallons per minute (which may also be more than plenty to extinguish the fire). In some of these instances the pump will run loudly. Accordingly, there is room for improvement.

SUMMARY OF THE INVENTION

Applicant has recognized that in some instances when a pump runs at a lower flow rate, the pump may run loudly or with noise that is greater than when the pump was performing at a higher flow rate at an equal discharge pressure. Applicant appreciates that on occasion a 1500 GPM or higher rated fire pump may be called to extinguish a minor fire. In such cases a high-capacity single impeller pump may tend to run loudly if the pump is at lower impeller speed and smaller volume output. Applicant has developed a pump casing and pump which provides output to opposite sides of the pump while maintaining low noise throughout various operational ranges of the pump, including from high speed, high volume through high speed, lower volume discharge.

In one aspect the invention includes a single piece pump casing allowing discharge flow from the pump at opposite sides of the pump and associated firefighting vehicle. The pump casing has a first cut-water fluid flow path defined at least in part by a first cut-water wall, a second cut-water fluid flow path defined at least in part by a second cut-water wall, a first joint-water path and a second joint-water path, the first cut-water fluid flow path and the second cut-water fluid flow path communicating with the first joint-water path and the second joint-water path, the first joint-water path communicating with a first discharge nozzle and the second joint-water path communicating with a second discharge nozzle, the second cut-water wall spanning less than 180 degrees from a leading edge of the second cut-water wall to a trailing edge of the second cut-water wall.

In a further aspect the invention includes a single piece pump casing having a first cut-water fluid flow path defined at least in part by a first cut-water wall, a second cut-water fluid flow path defined at least in part by a second cut-water wall, a first joint-water path and a second joint-water path, the first cut-water fluid flow path and the second cut-water fluid flow path communicating with the first joint-water path and the second joint-water path, the first joint-water path communicating with a first discharge nozzle and the second joint-water path communicating with a second discharge nozzle, the first discharge nozzle and the second discharge nozzle situated substantially at opposing ends of the casing, the first discharge nozzle defining a first center output point and the second discharge nozzle defining a second center output point, the first center output point and the second center output point defining a line offset from a center point of a center opening passing through the casing, a leading end of the first cut-water wall positioned in a spaced relation with respect to a horizontal centerline running through the center point. In aspects the cut-water walls define a cutwater diameter passing through a center point of a center opening of the casing, the cutwater diameter is greater than 1.07 times the impeller diameter. In further aspects the cutwater diameter is substantially greater than the impeller diameter, in some instances being 1.16, 1.17 times or even greater as compared to the impeller diameter.

In a further aspect the invention includes a single piece casing having a first cut-water fluid flow path defined at least in part by a first cut-water wall, a second cut-water fluid flow path defined at least in part by a second cut-water wall, a first joint-water path and a second joint-water path, the first cut-water fluid flow path and the second cut-water fluid flow path communicating with the first joint-water path and the second joint-water path, the first joint-water path communicating with a first discharge nozzle and the second joint-water path communicating with a second discharge nozzle, the first cut-water wall and the second cut-water wall defining a cutwater diameter passing through a center point of a center opening of the casing, the cutwater diameter having a constant measure from a lead end of the first cut-water wall toward a trailing end of the first cut-water wall. In aspects, the casing has a lead end of the second cut-water wall, were from the lead end toward a trailing end of the second cut-water wall, the diameter transitions from having a constant measure to having a varying measure.

In a further aspect the invention is a single-piece casing having a single discharge nozzle, a first cut-water fluid flow path defined at least in part by a first cut-water wall, a second cut-water fluid flow path defined at least in part by a second cut-water wall, a first joint-water path leading to the discharge nozzle, the first cut-water wall and the second cut-water wall defining a cutwater diameter passing through a center point of a center opening of the casing, the cutwater diameter having a constant measure from a lead end of the first cut-water wall toward a trailing end of the first cut-water wall. In aspects, the casing is configured to receive an impeller having an impeller diameter, the cutwater diameter being greater than 1.07 times the impeller diameter. In aspects the cutwater diameter is substantially greater than the impeller diameter, including at least 1.16 time the impeller diameter. In aspects, the second cut-water wall spans less than 180 degrees from a leading edge of the second cut-water wall to a trailing edge of the second cut-water wall.

The above partial summary of the present invention is not intended to describe each illustrated embodiment, aspect, or every implementation of the present invention. The figures and detailed description that follow more particularly exemplify these embodiments and further aspects of the invention.

Figure 5:
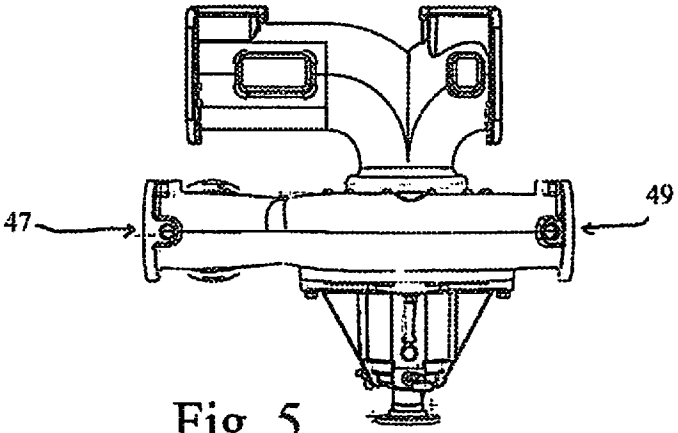
FIG. 5 is a top view of FIG. 4.

While the invention is amenable to various modifications and alternative forms, specifics thereof have been shown by way of example in the drawings and will be described in detail. It should be understood, however, that the intention is not necessarily to limit the invention to the particular embodiments or aspects described. On the contrary, the intention is to cover all modifications, equivalents, and alternatives falling within the spirit and scope of the invention and as defined by the appended claims.

DETAILED DESCRIPTION OF THE INVENTION

Figure 2:
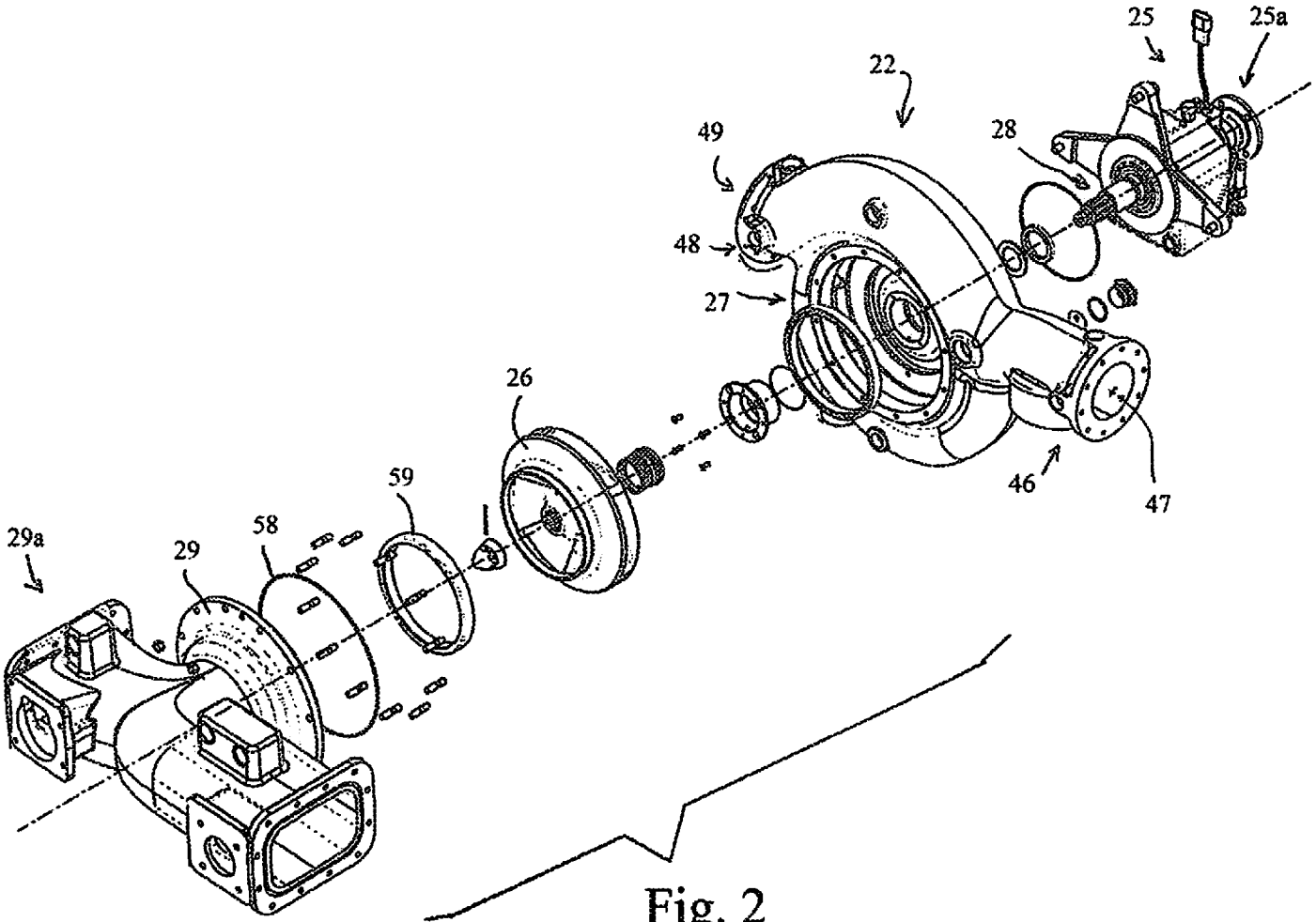
FIG. 2 is an exploded perspective view of FIG. 1.

Referring to FIGS. 1-12, casings, pumps, systems and vehicles are presented in various aspects of the invention. A pump according to the present invention is generally depicted with reference to numeral 20. In one aspect, pump 20 includes a casing 22 which in one aspect is a single piece metal casting. The casing 22 may be made of metals including iron or aluminum or other metals or alloys. In one aspect casing 22 is made with or from ductile iron. Casing 22 includes an outer casing wall 24. Casing wall 24 in one aspect is curved or generally circular, and defines an impeller cavity 27 in which is positioned an impeller 26. Impeller drive shaft 28 runs through center opening 23 and cavity 27 and secures impeller 26 to drive the impeller 26. A drive box 25 houses the drive shaft 28 and is capable of housing bearings and seals and/or gears and lubricant and is driven by yoke 25*a* connected to a drive source to power pump 20. A suction head 29 overlays impeller 26. Fluid is introduced through head 29 (and other suction plumbing 29*a*) and into impeller 26 for subsequent discharge through discharge nozzles 46, 48. The fluid is used for firefighting purposes, for instance. Pump 20 further includes O rings 58, seal rings 59 and other common pump hardware as generally shown in FIG. 2.

Figure 3:
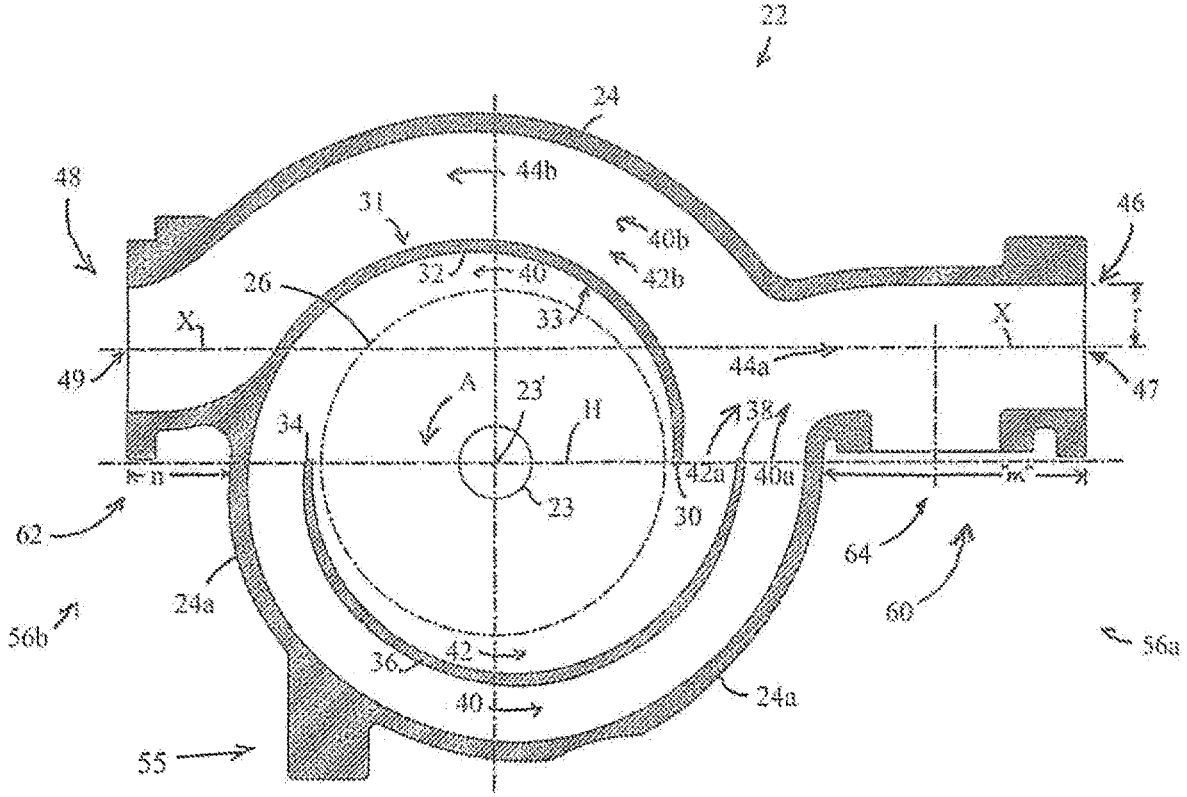
FIG. 3 is a section view taken along line 3-3 of FIG. 1 with portions removed for clarity.

With particular reference to FIG. 3, casing 22 includes a first cut-water wall 32 having a first cut-water 30 disposed at a leading end thereof. First cut-water wall 32 includes an impeller side 33 having a generally concave configuration, and a casing side 31 having a generally convex configuration. First cut-water wall 32 in part defines first cut-water fluid flow path 40. As fluid exits spinning impeller 26 the fluid travels along first cut-water fluid flow path 40. Subsequent flow of the fluid within path 40 is described further below.

Casing 22 includes second cut-water wall 36 having a second cut-water 34 disposed at a leading end of the second cut-water wall 36 and a cut-water wall trailing end 38 at a trailing end of wall 36. Second cut-water wall 36 in part defines second cut-water fluid flow path 42. As fluid exits spinning impeller 26 the fluid travels along second cut-water fluid flow path 42. Subsequent flow of the fluid within path 42 is described further below.

Figure 6:
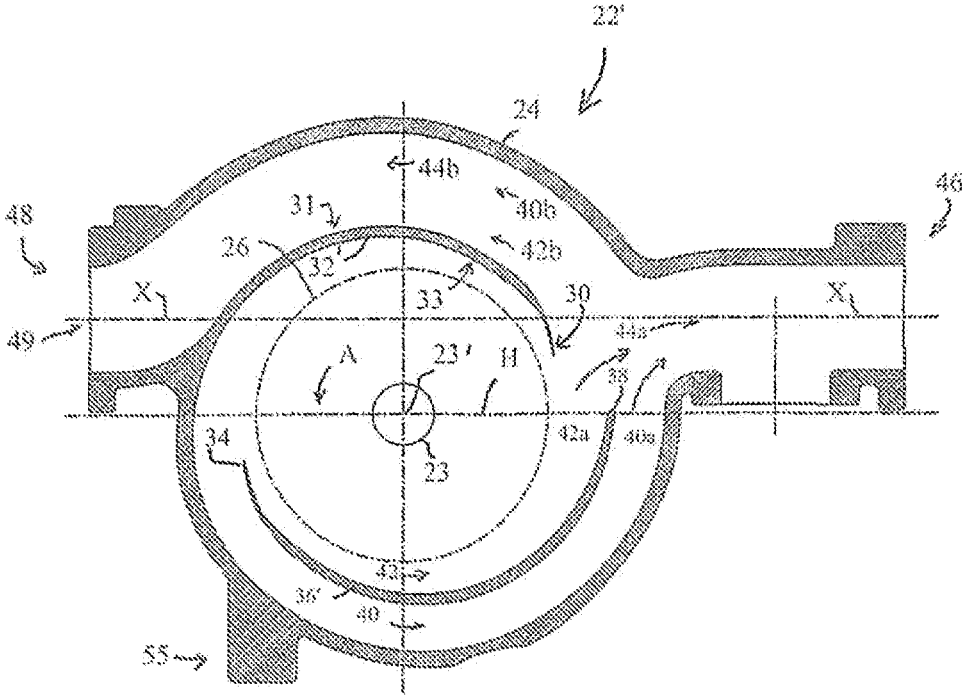
FIG. 6 is a section view taken along line 3-3 of FIG. 1 in an alternative aspect of the invention.
Figure 7:
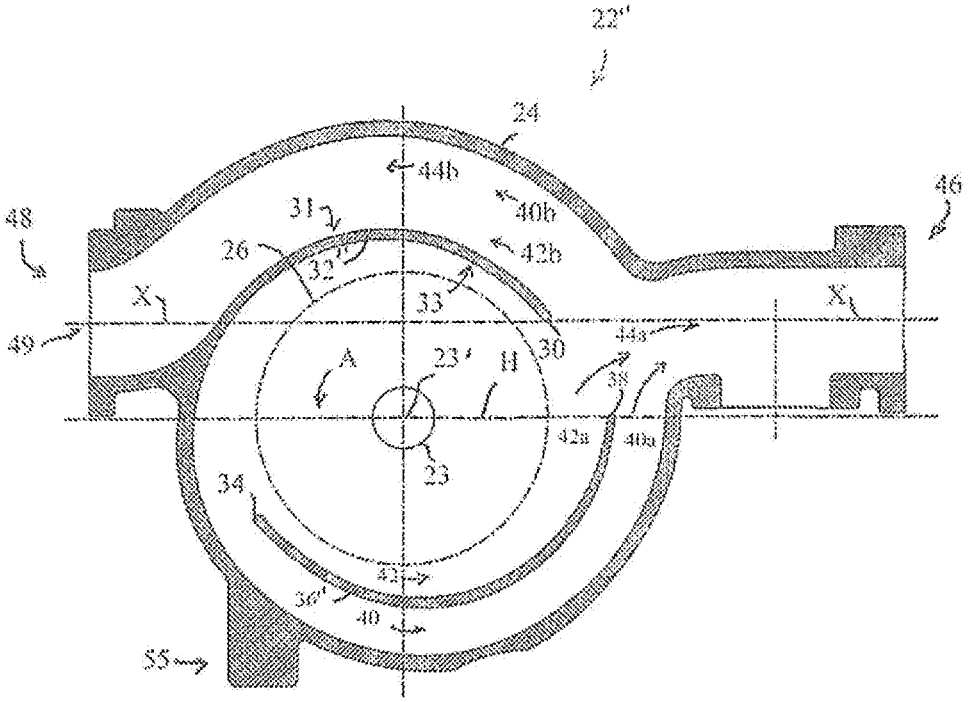
FIG. 7 is a section view taken along line 3-3 of FIG. 1 in a further alternative aspect of the invention.

Referring to FIG. 3, FIG. 6, and FIG. 7, first cut-water fluid flow path 40 and second cut-water fluid flow path 42 communicate to join into a first joint water path 44*a* and a second joint water path 44*b*. Casing 22, 22', 22" further includes a first discharge nozzle 46 and a second discharge nozzle 48. Both first path 40 and second path 42 communicate with first discharge nozzle 46 and second discharge nozzle 48. Both first joint water path 44*a* and second joint water path 44*b* communicate with first discharge nozzle 46 and second discharge nozzle 48. First discharge nozzle 46 and second discharge nozzle 48 are situated at or substantially at opposing ends 56*a*, 56*b* of casing 22, 22', 22". In further aspects discharge nozzles 46, 48 have a center output 47, 49 (particularly, first center output point 47 and second center output point 49) which define a center point of the respective nozzles. A horizontal centerline H aligns with a horizontal center of impeller drive shaft 28. In further aspects horizontal centerline H aligns with a center point 23' of center opening 23. The center output points 47, 49 define a line "X" which line X is offset from horizontal centerline H. In further aspects, centerline H is not necessarily horizontal, yet line "X" may be parallel to centerline H. In one aspect, centerline H is horizontal when casing 22, 22', 22" is positioned with a bottom surface of foot 55 oriented along or resting on a horizontal surface. Alignment of nozzles 46, 48 accommodates for efficient dual outlets to be extended to both sides of an emergency vehicle. An emergency response vehicle may be a fire truck such as, but not limited to, the vehicle 10 shown in FIG. 12. Vehicle 10 may include a fire truck which may include a tilt-forward cab 12 as well as various rear panels and compartments, a holding tank or tanks, discharge panels and various other components which are common to firetrucks or other emergency response vehicles. The invention is not limited to use with the vehicle 10 as shown, and may be used with other response vehicles and fire trucks or fire apparatus.

In one aspect nozzles 46, 48 have a terminal flow path radius "r" (i.e., a flow path radius at a terminal end of nozzle 46). In one aspect the radius "r" is 2 inches. In other aspects the radius "r" may be less than or greater than 2 inches. In further aspects, nozzles 46, 48 have a terminal flow path which is not necessarily circular in cross-section, and may have a rectangular, oval or other cross-section configuration. In aspects, line X (and corresponding output points 47, 48 of nozzles 46, 48) is offset from centerline H by a measure of at least "r" length. In one aspect, casing 22 defines a center opening 23 which passes through the casing 22. The center opening 23 has a radius r' with a center point 23' of the center opening 23 defining a horizontal center point which lies along centerline H. In one aspect, line X is offset from centerline H by a measure of at least r' length. In a further aspect, line X is offset from centerline H by about 3 to 4 inches. In aspects line X is offset from centerline H by about 3.5 inches to assure a substantial benefit in space savings while still maintaining clearance from other components of the vehicle. Such offset allows casing 22, 22', 22" and pump 20 to be set lower within a vehicle. In one aspect, line X is offset from centerline H by over 3.6 inches, resulting in a corresponding lowering of casing 22, 22', 22" as compared to prior applications. Such lowering is a substantial lowering and increase in space utilization for a vehicle into which pump 20 is positioned. In aspect such substantial lowering accommodates more space within a cab portion of the vehicle which is positioned above the pump. Use of the offset and lowering of the profile position of the pump minimizes or eliminates the need to have a projection into the cab area to accommodate for pump clearance. This lessens or eliminates a "bump" which might otherwise be positioned at the floor of the cab.

In a further aspect casing 22, 22', 22" includes a foot 55 used to set upon or connect to a flange which in one instance is connected to a rail of the vehicle. Connection of nozzles 46 48 to discharge piping and connection of foot 55 to rail provides a secure three-point contact to secure the pump casing 22. In one aspect foot 55 is configured with a planar lower surface such that when the planar lower surface is oriented horizontally, line X is also oriented horizontally or substantially horizontally. Plastic or rubber washers or bushings may be positioned at the respective connections of the casing 20.

In operation, fluid from path 40 continues to circulate through casing 22, 22', 22". Particularly, a portion of fluid travels along first cut-water fluid flow path 40*a* to exit at discharge nozzle 46, and a portion travels, or may travel, along first cut-water fluid flow path 40*b* to exit at discharge nozzle 48. Likewise, fluid from path 42 continues to circulate through casing 22, 22', 22". Particularly, a portion of fluid travels along second cut-water fluid flow path 42*a* to exit at discharge nozzle 46, and a portion travels, or may travel, along second cut-water fluid flow path 42*b* to exit at discharge nozzle 48. Joint water path 44*a* includes both first path 40*a* and second path 42*a*, and joint water path 44*b* includes both first path 40*b* and second path 42*b*. It may be appreciated that at least a portion of path 40 and at least a portion of path 42 define path 40*b* to create joint water path 44*b*. As such, both the impeller side 33 and casing side 31 of wall 32, 32', 32" in part define first cut-water fluid flow path 40. First cut-water wall 32, 32', 32" defines in part flow path 40 and defines in part second joint-water path 44*b*. Having joint-water path 44*b* allows pump 20 to efficiently deliver fluid to ends 56*a*, 56*b* in a low-profile arrangement. While other pump designs may deliver fluid to both ends of a vehicle, joint-water path 44*b* contained entirely within casing 22, 22', 22" achieves an efficient low-profile arrangement. Having outputs 47, 49 of discharge nozzles 46, 48 arranged along a line X which is offset upward from a center point 23' of the center opening 23 allows for a lower profile configuration. As a single casting, casing 22, 22', 22" also accommodates for efficient manufacture and assembly of pump 20 and positioning and connecting within a vehicle. In one aspect pump 20 includes a single impeller 26 (one and only one impeller in such aspect) and thus a single suction for efficient use and plumbing. In aspects, either of nozzles 46, 48 may be closed to allow or force liquid to flow to the other open nozzle to allow a user to select which side (or both sides) of the pump (or fire truck) for discharge of liquid.

Joint-water path 44*b* allows for efficient operation of pump 20 especially where an operator desires to vary the fluid output through respective discharge nozzles 46, 48. For instance, a user may close off (or partially close) fluid flow through nozzle 46 without disrupting radial balance of impeller 26, since the entire output from flow path 40 and flow path 42 would then be directed through nozzle 48. Likewise, if a user were to close fluid flow through nozzle 48 (or partially close the flow), the output from flow path 40 and flow path 42 would then be directed through nozzle 46. If respective nozzles 46, 48 were to be otherwise fed directly from respective flow paths without the combining of fluid in a joint water path, radial forces could disrupt the balance of impeller 26 impacting performance and pump life. Having water paths 40 and 44*b* contained within a single casing further allows for a low profile which would otherwise require additional or external plumbing about the pump casing to supply opposite sides of the vehicle. Other outlets or nozzles may also be provided on the casing 22, 22', 22", including at discharge arm 60.

In further aspects of operation, impeller 26 spins in a first direction represented by arrow A. While arrow A depicts a counterclockwise direction (when viewed opposite a suction side of the casing 22, 22', 22"), it may be appreciated that pump 20 may be designed for impeller 26 to spin in a clockwise direction. The first-direction spinning impeller 26 releases fluid (such as water or foam for fighting fires) into paths 40, 42. In aspects, pump 20 includes means for continuing transporting fluid in the first direction. Means for transporting is represented by reference numeral 44*b*, which may include means such as second joint-water path 44*b*, first cut-water fluid flow path 40*b*, and second cut-water fluid flow path 42*b*. In one aspect, means 44*b* has a generally arch-like configuration, or lies generally along a radius or modified radius. In one aspect means for transporting includes a joint-water path spanning substantially from a first end 56*a* to a second end 56*b* of the pump 20. In one aspect means 44*b* spans from adjacent trailing edge 38 to first discharge outlet 46 and continues to span to second discharge outlet 48. In one aspect means for continuing transporting is contained entirely within single piece casing 22, 22', 22". Providing a simple single, non-split, casing design in which all water paths are located (including means for continuing transportation, such as path 44*b* which curves to either side of the casing) allows for ease of manufacture, assembly, hook-up, and use. It may be appreciated that connections to the nozzles of the pump may likewise be confined to a modest space to achieve an overall low-profile solution.

For pump 20 to accommodate dual output at discharge nozzles 46, 48, pump 20 in one aspect includes joint-water path 44*b* which spans at least 45 degrees, and in some aspects at least 135 degrees, and even at least 180 degrees or greater than 180 degrees in further aspects. Having joint-water path 44*b* span at least 135 degrees accommodates for joint-water path 44*b* to wrap back or span to a significant degree, and accommodates a lower profile casing (and/or elimination of external conduit to supply fluid to opposite sides of the firetruck) and provides meaningful spacing of respective outputs or nozzles 46, 48. The joint-water path 44*b* spans in a curving manner along an arch generally defined by an arch line spanning from trailing edge 38 to discharge outlet 48. In one aspect arch line is a curving centerline of joint-water path 44*b*. Joint-water path 44*b* may commence adjacent trailing edge 38 of second cut-water wall 36 and follows generally circumferentially in direction A to discharge nozzle 48. In one aspect trailing edge 38 aligns along or substantially along reference line H. In one aspect with respect to FIG. 3, cut-water 30 also aligns along or substantially aligns along reference line H. In one aspect, cut-water 34 aligns along or substantially along reference line H. In other aspects cut-water 30 and/or cut-water 34 are positioned in a spaced relation with respect to line H, such as with respect to FIG. 6 and FIG. 7. Reference line H is a centerline running through impeller shaft 28 (or running through center point 23'). In one aspect joint-water path 44*b* spans approximately 180 degrees from trailing edge 38 to reference line H. In one aspect joint-water path 44*b* spans greater than 180 degrees to accommodate configuration of discharge nozzles being positioned at substantially opposite ends 56*a*, 56*b*. In one aspect, due to the substantial offset of reference line X (defined by center points 47, 49), joint water path 44*b* avoids spanning across horizontal centerline H. In one aspect joint water path 44*b* spans less than 180 degrees. In aspects, all liquid output from nozzles 46, 48 occurs above horizontal centerline H.

In further aspects with respect to FIG. 3 first cut-water fluid flow path 40 is defined in part by lower casing wall 24*a*. The first discharge nozzle 46 is positioned at a first discharge arm 60 which extends outward from the lower casing wall 24*a*. Likewise, second discharge nozzle 48 is positioned at a second discharge arm 62 which extends outward from the lower casing wall 24*a*. In one aspect, discharge arms 60, 62 are positioned above horizontal centerline H. In one aspect first discharge arm 60 extends from lower casing wall 24*a* a first distance "m" and second discharge arm 62 extends from lower casing wall 24*a* a second distance "n". In one aspect the first distance m is greater than the second distance n. In one aspect distance m is twice as great as distance n, and in other aspects distance m is greater than twice distance n. In a further aspect distance m is about 8 inches and distance n is about 3 inches. In further aspects distance m is greater than 8.2 inches and distance n is greater than about 3.3 inches. Other measures for distance m and distance n may be established or mixed and matched to provide efficiency of connection to discharge piping.

In one aspect first discharge arm 60 is positioned adjacent trailing edge 38 of second cut-water wall 36, while second discharge arm 62 is position distal the trailing edge 38. In further aspects, fluid travels upward at the exit (adjacent trailing edge 38) from the first cut-water fluid flow path 40.

Figure 4:
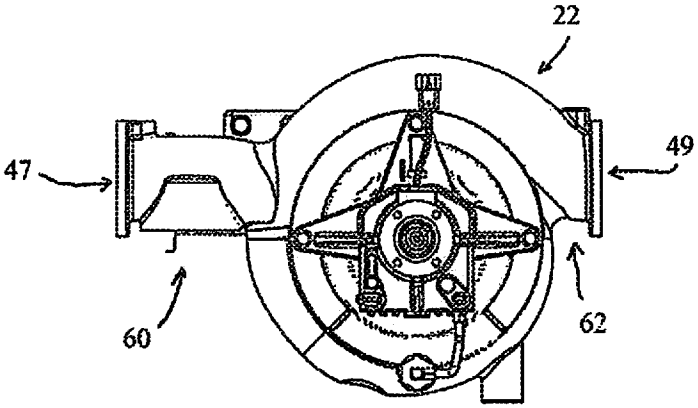
FIG. 4 is a rear view of FIG. 1.
Figure 1:
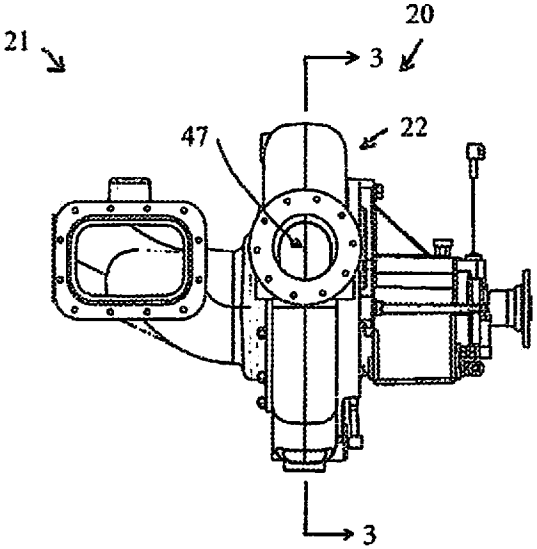
FIG. 1 is a side view of a pump system, pump, pump casing and related components in accordance with one aspect of the invention.
Figure 8:
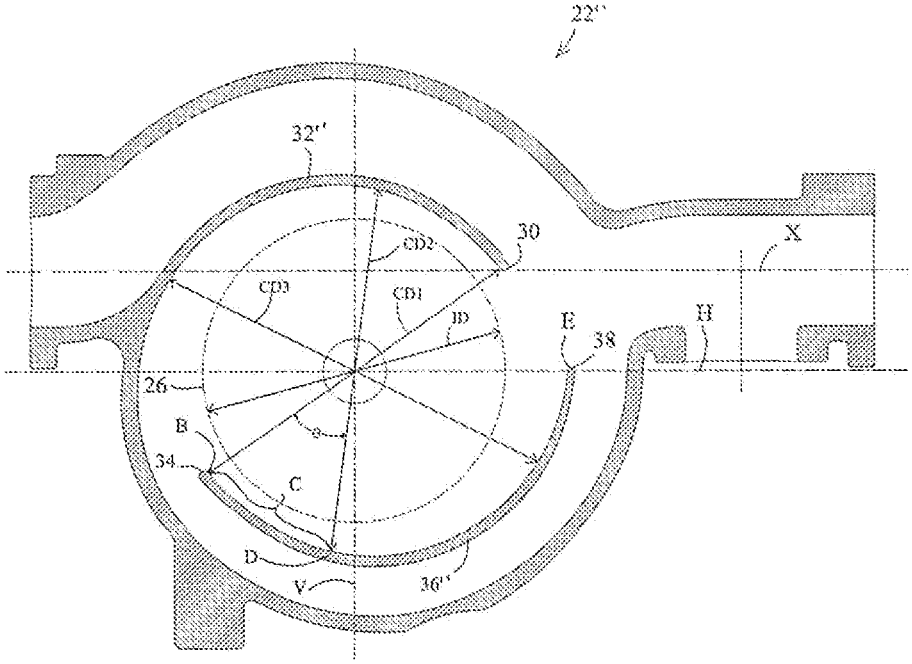
FIG. 8 is a section view taken along line 3-3 of FIG. 1 in the alternative aspect of FIG. 7.

As shown in FIG. 3 and as may be further appreciated with respect to FIG. 4 and FIG. 5, reference line X is defined by center points 47, 49. Center points 47, 49 in one aspect are aligned along line X in both a horizontal orientation (FIGS. 3 and 4) and a casing bisecting orientation as shown in top view of FIG. 5. The same or similar reference line X is shown in FIG. 6, FIG. 7 and FIG. 8.

In a further aspects with respect to FIG. 6 and FIG. 7, respective casings 22', 22" include a first cut-water wall 32', 32" having a first cut-water 30 disposed at a leading end thereof. First cut-water wall 32', 32" includes an impeller side 33 having a generally concave configuration, and a casing side 31 having a generally convex configuration. First cut-water wall 32', 32" in part defines first cut-water fluid flow path 40. As fluid exits spinning impeller 26 the fluid travels along first cut-water fluid flow path 40. Subsequent flow of the fluid within path 40 is described further below.

Casing 22', 22" includes second cut-water wall 36', 36" having a second cut-water 34 disposed at a leading end of the second cut-water wall 36', 36" and cut-water wall trailing end 38 at a trailing end of wall 36', 36". Second cut-water wall 36', 36" in part defines second cut-water fluid flow path 42. As fluid exits spinning impeller 26 the fluid travels along second cut-water fluid flow path 42. Subsequent flow of the fluid within path 42 is described above with respect to FIG. 3 and also described further below.

First cut-water fluid flow path 40 and second cut-water fluid flow path 42 communicate to join into a first joint water path 44*a* and a second joint water path 44*b*. Casing 22', 22" further includes a first discharge nozzle 46 and a second discharge nozzle 48. Both first path 40 and second path 42 communicate with first discharge nozzle 46 and second discharge nozzle 48. Both first joint water path 44*a* and second joint water path 44*b* communicate with first discharge nozzle 46 and second discharge nozzle 48. First discharge nozzle 46 and second discharge nozzle 48 are situated at or substantially at opposing ends 56*a*, 56*b* of casing 22', 22". In further aspects discharge nozzles 46, 48 have a center output 47, 49 (particularly, first center output point 47 and second center output point 49) which define a center point of the respective nozzles. A horizontal centerline H aligns with a horizontal center of impeller drive shaft 28. In further aspects horizontal centerline H aligns with a center point 23' of center opening 23. The center output points 47, 49 define a line "X" which line X is offset from horizontal centerline H. In further aspects, centerline H is not necessarily horizontal, yet line "X" may be parallel to centerline H. In one aspect, centerline H is horizontal when casing 22, 22', 22" is positioned with a bottom surface of foot 55 oriented along or resting on a horizontal surface. Alignment of nozzles 46, 48 accommodates for efficient dual outlets to be extended to both sides of an emergency vehicle. An emergency response vehicle may be a fire truck such as, but not limited to, the vehicle 10 shown in FIG. 12. Vehicle 10 may include a fire truck which may include a tilt-forward cab 12 as well as various rear panels and compartments, a holding tank or tanks, discharge panels and various other components which are common to firetrucks or other emergency response vehicles. The invention is not limited to use with the vehicle 10 as shown, and may be used with other response vehicles and fire trucks or fire apparatus, skids or trailers.

In aspects casing 22', 22" includes features noted above with respect to casing 22, and casings 22, 22' operate similarly or substantially similarly. Pumps 20 made with respective casings 22, 22' exhibit desired low noise characteristics. Variations in the noise characteristics may be achieved by employing the various features of casings 22, 22'.

FIG. 6 shows cut-water wall 32', 36' having first cut-water 30 and second cut-water 34 positioned in a spaced relationship with respect to horizontal line H. The walls 32', 36' are reduced or cut back compared to the walls 32, 36 of FIG. 3. Reducing or cutting back the walls 32', 36' also create a larger space between the walls 32', 36' and the impeller 26. Reducing or cutting back the walls 32', 36' and/or increasing the distance between the cut-waters 30, 34 and the impeller 26, results in improved noise characteristics as described herein.

FIG. 7 also shows cut-water wall 32", 36" having first cut-water 30 and second cut-water 34 positioned in a spaced relationship with respect to horizontal line H. The walls 32", 36" are reduced or cut back compared to the walls 32, 36 of FIG. 3 and FIG. 6. Reducing or cutting back the walls 32", 36" also create a larger space between the walls 32", 36" and the impeller 26. Reducing or cutting back the walls 32", 36" and/or increasing the distance between the cut-waters 30, 34 and the impeller 26, results in improved noise characteristics as described herein.

In further aspects, FIG. 8 illustrates casing 22" where the first cut-water wall 32" and the second cut-water wall 36" define a cutwater diameter which passes through center point 23' of center opening 23 of casing 22'. The diameter spans from an impeller side 33 of wall 32" to an impeller side of wall 36". In one aspect cutwater diameter CD1 is shown as passing through center point 23' and spanning between respective walls 32", 36" at or near respective cut-waters 30, 34 or at or near leading ends of walls 32", 36". Impeller 26 has a constant impeller diameter ID. In one aspect the measure of the cutwater diameter, including cutwater diameter CD1, is greater than 1.07 times the impeller diameter ID. In some applications this feature results in improved noise characteristics as compared to the configuration shown in FIG. 3. In a further aspect, configuration of cutwater wall 32" where the cutwater diameter at or adjacent the first cut-water 30 is substantially greater than the impeller diameter ID results in improved noise characteristics, for instance where cutwater diameter CD is at least 1.16 times the impeller diameter ID. Typically there is an incentive to have a smaller diameter CD1 within a casing in order to create an overall smaller-sized casing, i.e., compacting components or features within the casing typically results in a smaller overall casing and thus more versatility. Indeed, there is a disincentive to have a greater diameter CD1 within a casing because of a corresponding increase in the overall size of the casing. Yet instead of reducing the diameter CD1, applicants have greatly expanded the diameter CD1 to produce unexpected lower noise. Applicants have also cut back the length of cut-water walls 32", 36" (i.e., compared to walls 32, 36, 32', 36') to produce unexpected lower noise. Moreover, the greater diameter of CD1 in combination with cut back of (reduction to) cut-water walls 32, 36 results in unexpected lower noise.

In one non-limiting, representative example, Example 1, impeller 26 of pump 20 has five vanes having an assumed thickness of about 0.59 inches, a 23-degree discharge angle, an outside diameter of about 10.9 inches, and a specific speed of about 1800 rpm using a 4 inch inside diameter water path. A cut-water diameter CD (i.e., CD1) of about 12.75 inches, which is 1.16 times the impeller diameter (i.e., ID) of 10.969 inches, provides a fully functioning and quieter pump as compared to having a much smaller cut-water diameter CD (such as a diameter CD1 of merely or less than 1.07 times the impeller diameter). For instance, Applicant has experienced lower decibel readings with the casings 22', 22" as compared to casing 22 (or other casing configurations) at various impeller speeds and pressure settings. In an aspect where the cut-water diameter CD1 is 12.875, the ratio is greater than 1.17 (1.17376) and provides even further noise reduction. Applicant believes larger ratios will provide further noise reduction.

It may be appreciated that to reduce noise, expanding the cut-water diameter CD1 of the casing 22 of FIG. 3 or FIG. 6 to be greater than 1.07 times the impeller diameter, or in some cases to be substantially greater than 1.07, such as 1.16 or 1.17 or greater, achieves improved lower noise levels.

Figure 9:
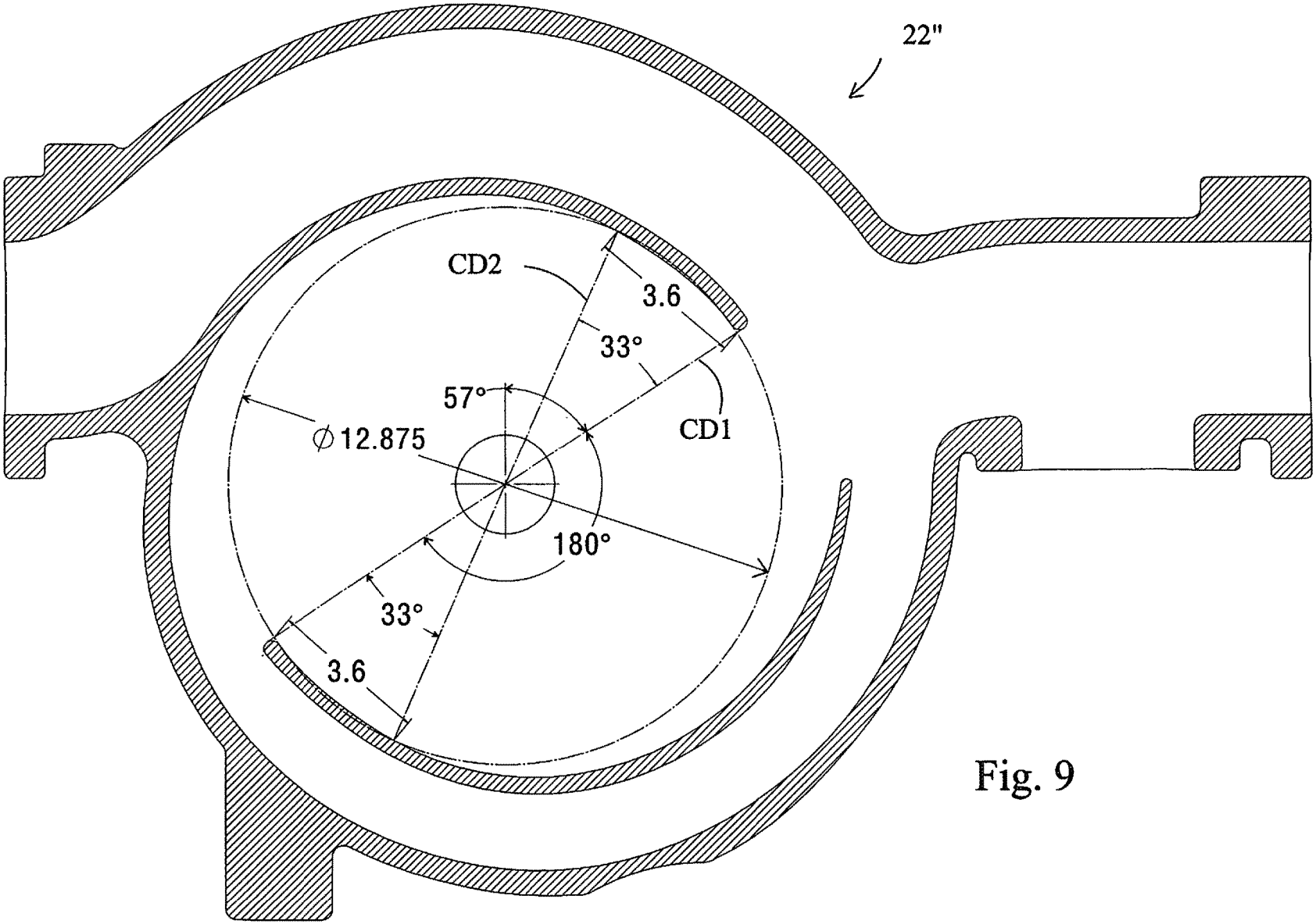
FIG. 9 is a section view taken along line 3-3 of FIG. 1 in the alternative aspect of FIG. 7.

In a further aspect with reference to FIG. 8 and FIG. 9, the cut-water diameter is constant throughout at least a portion of the cut-water walls 32", 36". For instance, in one aspect cutwater diameter CD1 has a measure that is the same as that of cutwater diameter CD2. In aspects, the cutwater diameter remains constant through region C, which spans from point B to point D along cut-water wall 36" (with a corresponding span along cut-water wall 32"). The length of the constant region C may vary from casing to casing depending on the desired characteristics and noise requirements. In one aspect region C spans at least one inch. In a further aspect region C spans 3.6 inches. In other aspects, angle theta θ measures approximately 33 degrees. Some variations may be acceptable due to manufacturing variations. In further aspects, angle theta measures 33 degrees. In one aspect point D may coincide with the vertical line "V", or may be located counterclockwise past vertical V. In other aspects, point D may be positioned closer to point B and as shown in FIG. 8. The cut-water diameter throughout the remaining portion of the cut-water walls 32", 36", represented in one aspect as spanning from point D to point E, does not remain constant. For instance, cutwater diameter CD3 is greater than cutwater diameter CD2, and cutwater diameter CD3 continues to change (increase) along the segment from position D to position E. In aspects, this cutwater diameter spirals outward or varies logarithmically. In aspects, the cutwater diameter varies along the entire segment D to E, and in other aspects, the cutwater diameter varies along at least a portion of segment D to E. Point D is considered a transition point or area of transition from a constant portion to a varying portion of the cut-water diameter between walls 32", 36". Applicant has found that having at least a portion of the region along the cut-water walls 32", 36" to be of constant diameter while transitioning to a portion having varying diameter results in less noise during operation of pump 20 at certain speeds and pressures. Such configuration also allows for a casing to have acceptable strength and output performance. In further aspects, the combination of an increased diameter CD1 together with cut back of wall 32", 36", together with a constant-to-varying diameter results in improved noise characteristics without sacrifice of output performance and durability.

A pump casing, such as that shown in FIG. 8 and FIG. 9, having a relatively greater cutwater diameter CD1 and a constant diameter through an initial portion C with a varying remainder diameter in the later portion of the cutwater walls, provides a pump with lower noise characteristics while also having desired structural strength and performance. Such configuration also satisfies hydrostatic pressure testing, including passing National Fire Protection Association (NFPA) standard 1901 testing for Automotive Fire Apparatus. The 2016 edition requires a Hydrostatic Test where "The pump body shall be subjected to a hydrostatic test to a minimum gauge pressure of 500 psi (3400 KPa) for a minimum of 10 minutes (Section 16.52.1). The casing 22" passes the hydrostatic testing of at least 500 psi for a minimum of 15 minutes without failure. In one aspect with respect to FIG. 9, where CD1 is 12.875 inches and the impeller diameter ID is 10.969 inches, the cut-water walls have a constant diameter through 33 degrees. The cut water walls 30, 34 in this aspect are also offset 33 degrees from a horizontal centerline.

Figure 10:
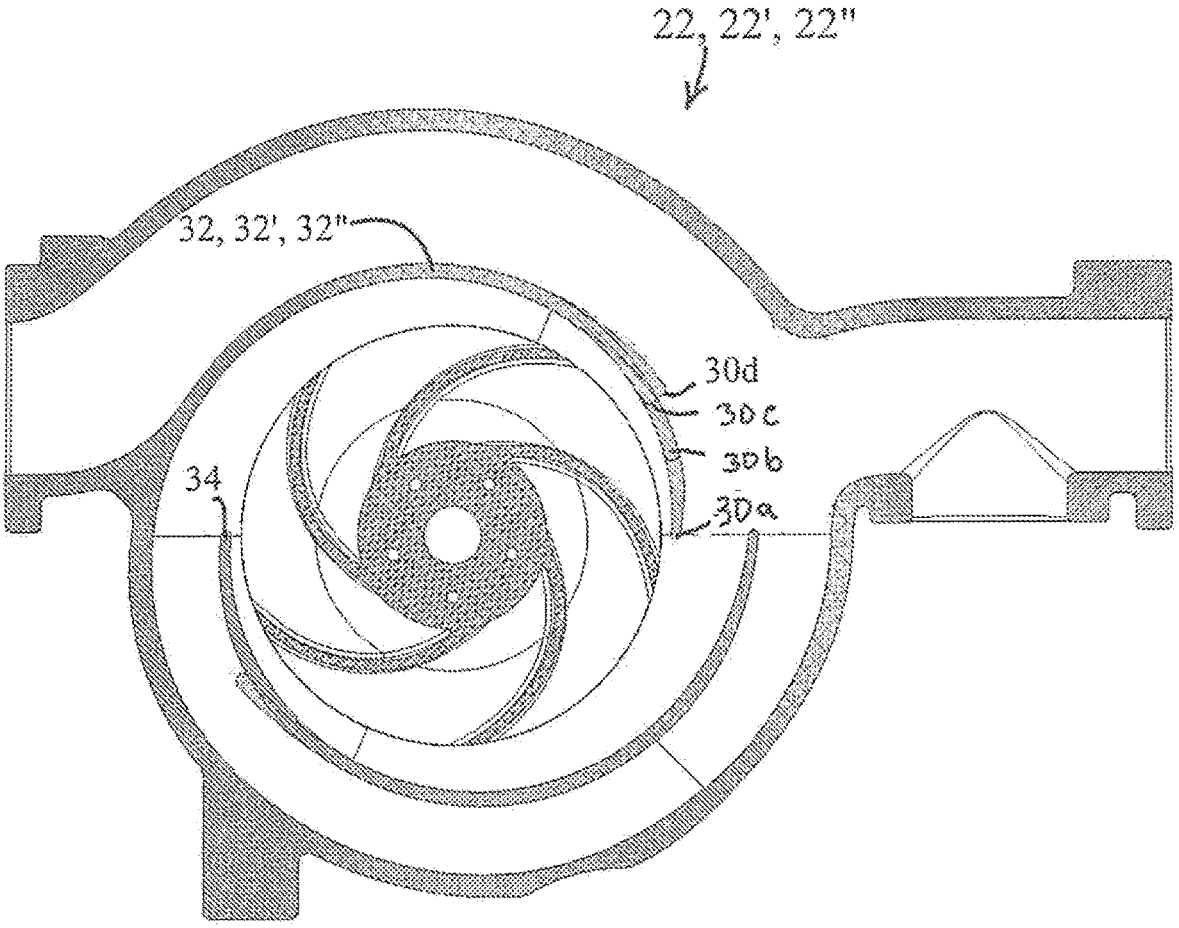
FIG. 10 is a representative section view taken along line 3-3 depicting various cut-water wall alternative aspects of the invention.

FIG. 10 is a section view depicting various cut-water wall configurations in accordance with aspects of the invention. Various section views of casing 22, 22', 22" (or slight modifications of those casings) are overlayed in the view of FIG. 10 to show the relative positions of the first cut-water 30, shown here respectively as cut-water 30*a*, 30*b*, 30*c* and 30*d*. Corresponding second cut-water 34 is also depicted. The cut-water 30*a* corresponds to the first cut-water 30 shown in FIG. 3. Cut-water 30*b* corresponds to the first cut-water 30 shown generally in FIG. 6. Cut-water 30*d* corresponds to the first cut-water 30 shown in FIG. 7 and FIG. 8. Cut-water 30*c* corresponds to an alternative first cut-water. It may be appreciated that as portions of cut-water wall 32 are removed (or "cut-back" in the design), the length of the CD1 increases, especially where cut-water wall spirals or has a varying diameter. A cut-water positioned at 30*b* has a greater diameter CD1 compared to a cut-water positioned at 30*a*. A cut-water positioned at 30*c* has a greater diameter CD1 compared to a cut-water positioned at 30*b*. A cut-water positioned at 30*d* has a greater diameter CD1 compared to a cut-water positioned at 30*c*. Where cut-water wall 32" includes a constant diameter, the CD1 of cut-water 30*d* is substantially greater compared to the CD1 of cut-water 30*a*. Cut-water 30*d* results in improved lower noise characteristics compared to a pump having a casing with cut-water 30*a*. Moreover, utilizing a cut-water wall 32" having, at least in part, a constant diameter, allows for producing a smaller overall casing 32". If the diameter CD1 of cut-water wall 32" were to vary (i.e., spiral or expand outward without at least a portion remaining constant), the cut-water wall 32" would continue to expand away from the impeller, resulting in, or requiring, an enlarged casing 22. Thus having a constant diameter CD1 portion of the cut-water wall 32" has an added benefit of maintaining or achieving a compact size of the overall casing.

Figure 11:
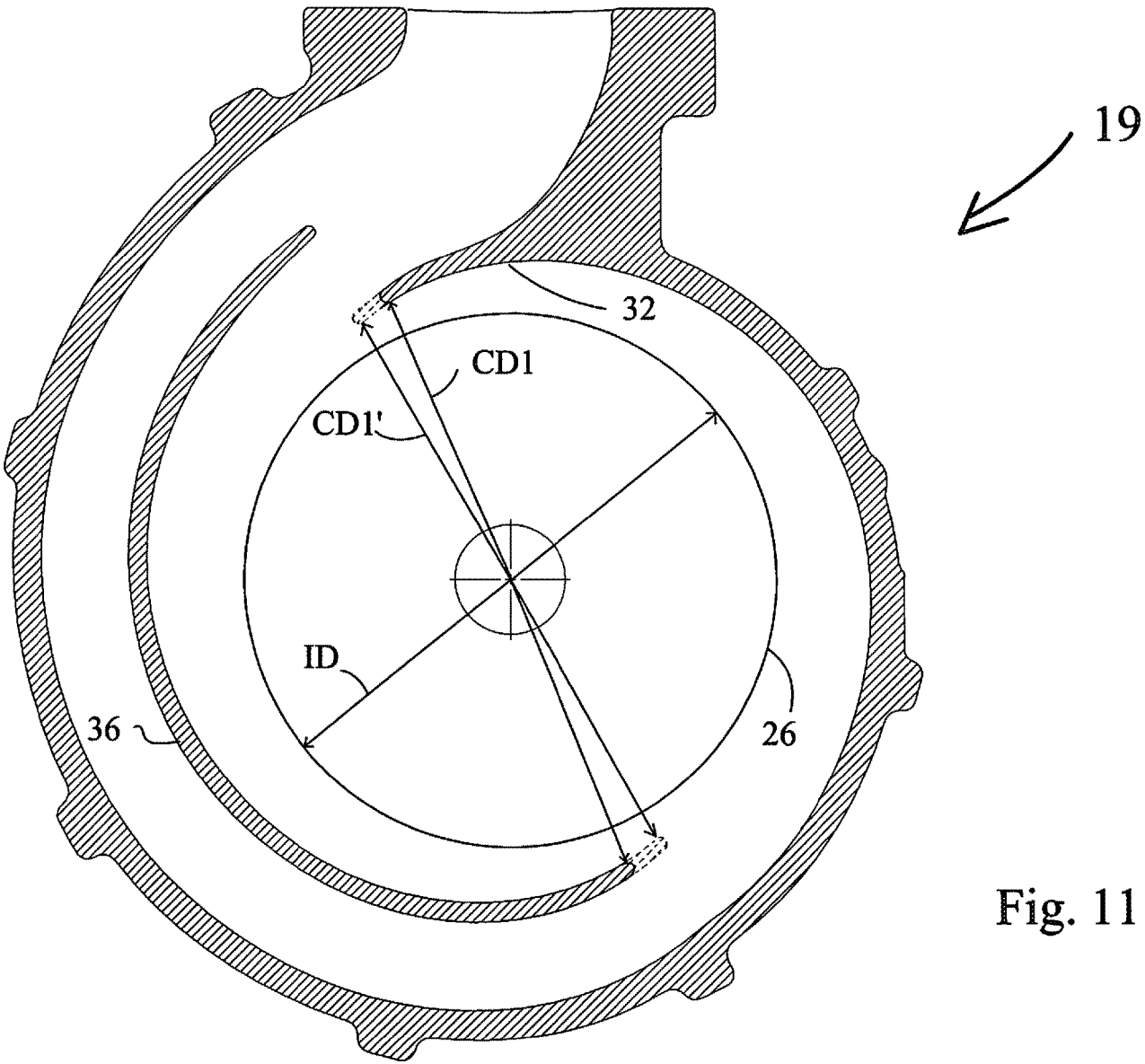
FIG. 11 is a section view of an alternative pump casing made utilizing aspects of the present invention.
Figure 12:
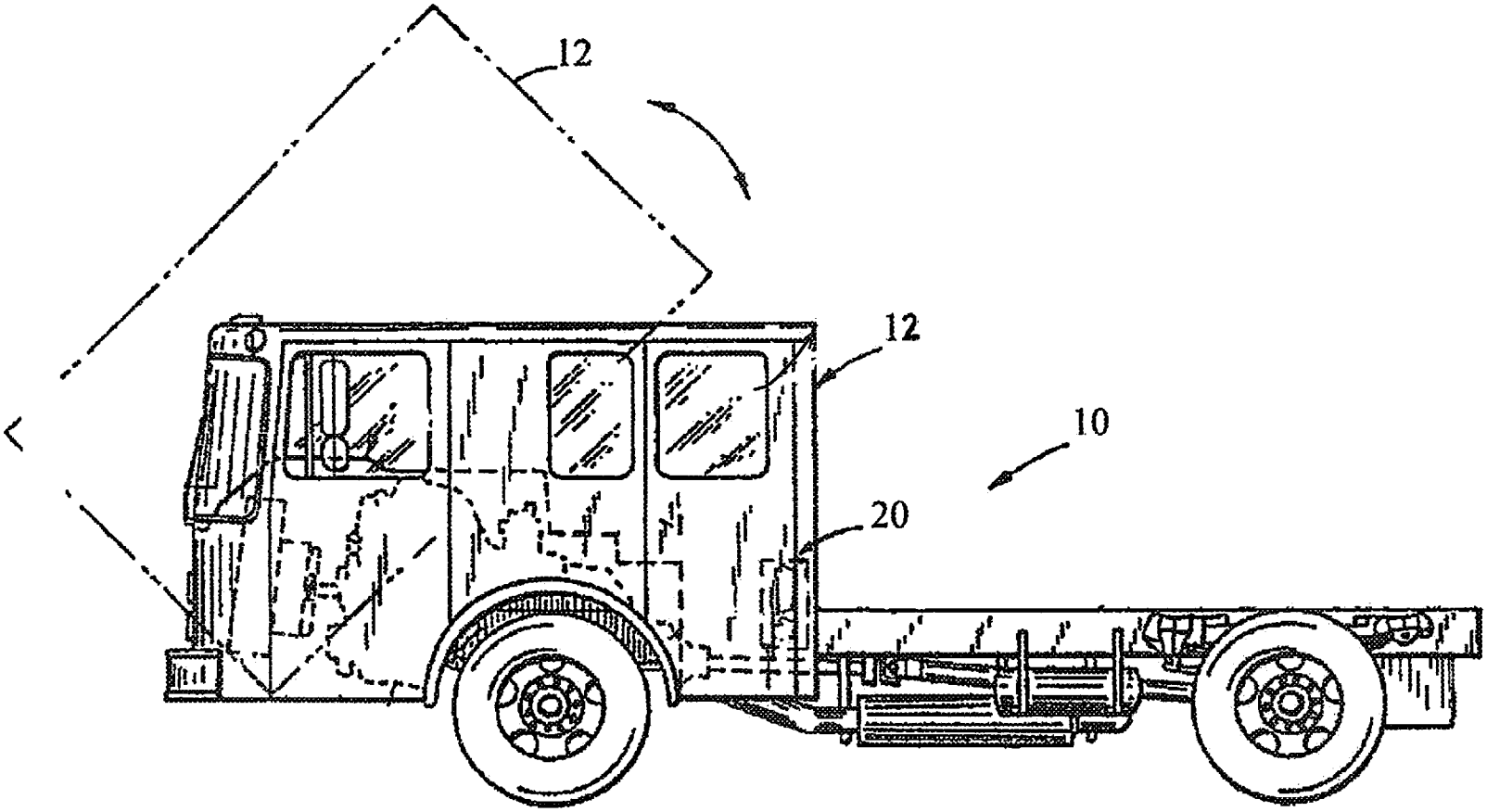
FIG. 12 is a side elevation view of a pump system and pump and vehicle in accordance with further aspects of the present invention.

FIG. 11 is a section view of a further aspect of the invention of a casing 19 having a single output nozzle, a first cut-water wall 32 and a second cutwater wall 36, and a cutwater diameter CD1 which measures at least 1.07 the diameter ID of the impeller 26. In aspects the CD1 is substantially greater than the ID, such as 1.16, or 1.17 or even greater. In aspects, the cutwater diameter passing through a center point of a center opening of the casing where the cutwater diameter has a constant measure from a lead end of the first cut-water wall toward a trailing end of the first cut-water wall.

Figure 13:
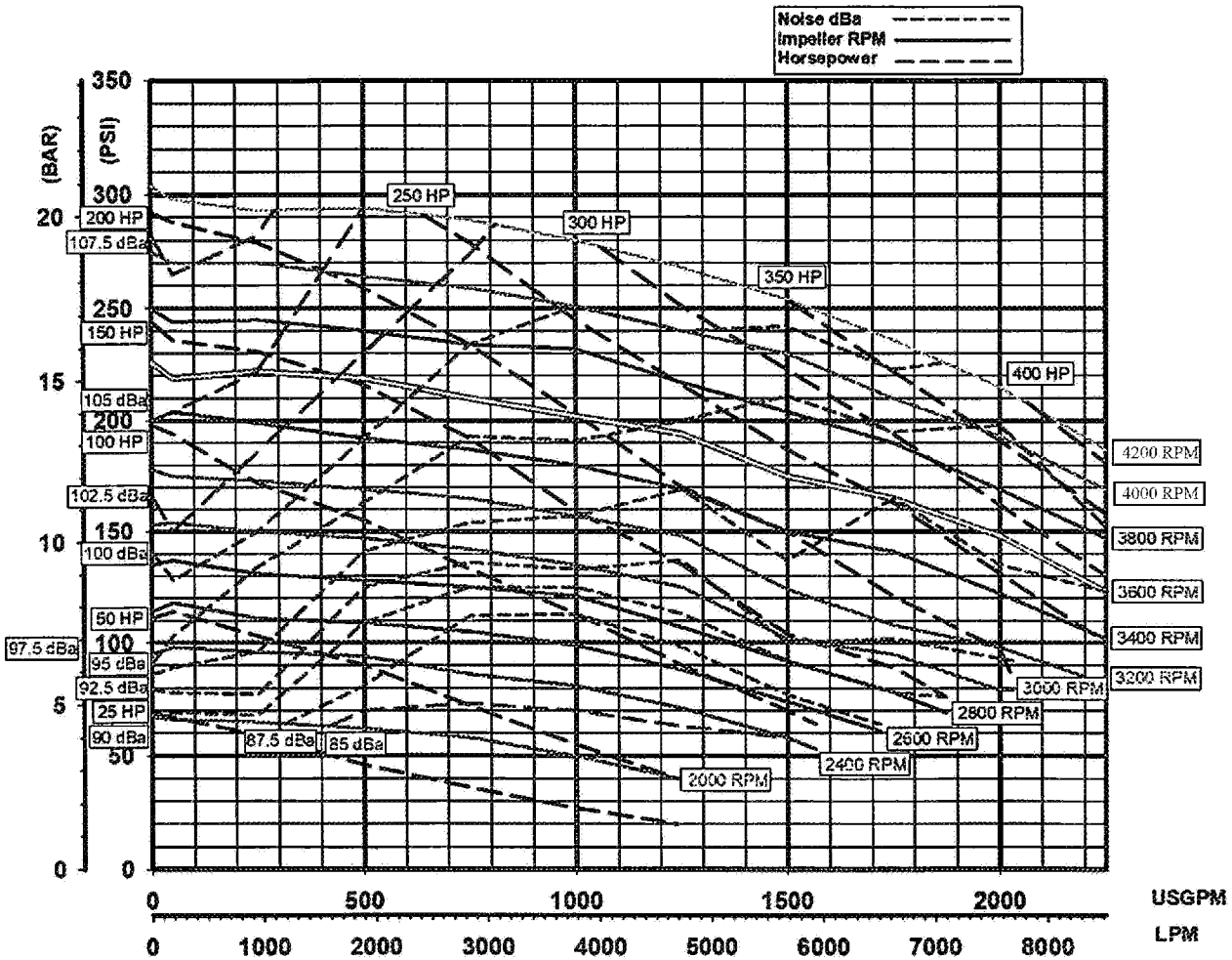
FIG. 13 is a chart pertaining to testing of a pump in accordance with one aspect of the invention.

In a further example, Chart 1 (as shown in FIG. 13) depicts outputs and noise characteristics at various parameters in the testing of a representative pump 20 with casing 22 (or similar casing) as shown in FIG. 3. The impeller used in this testing is the same as or similar to the impeller of Example 1. CD1 measured 11.518 inches.

Chart 1 presents various measurements of volume (USGPM/LPM), pressures (PSI/BAR), horsepower (HP), impeller speed (RPM), and Noise (dBa). In operation (the operational range of the pump 20), pump 20 runs in the following ranges: 0-250 PSI up to 1000 GPM, 0-200 PSI up to 1400 GPM, and 0-150 PSI up to 2000 GPM. A noise level of 95 dBa in some applications is considered a low noise level or an acceptable noise level. Measurements below 500 GPM and at operating pressure above 150 PSI, for instance, are shown in Chart 1 to greatly exceed 95 dBa. The line representing 95 dBa is shown to pass through a significant portion of the operational range of the pump. In some or many instances, a noise level above 95 decibels is unacceptable or undesired.

Figure 14:
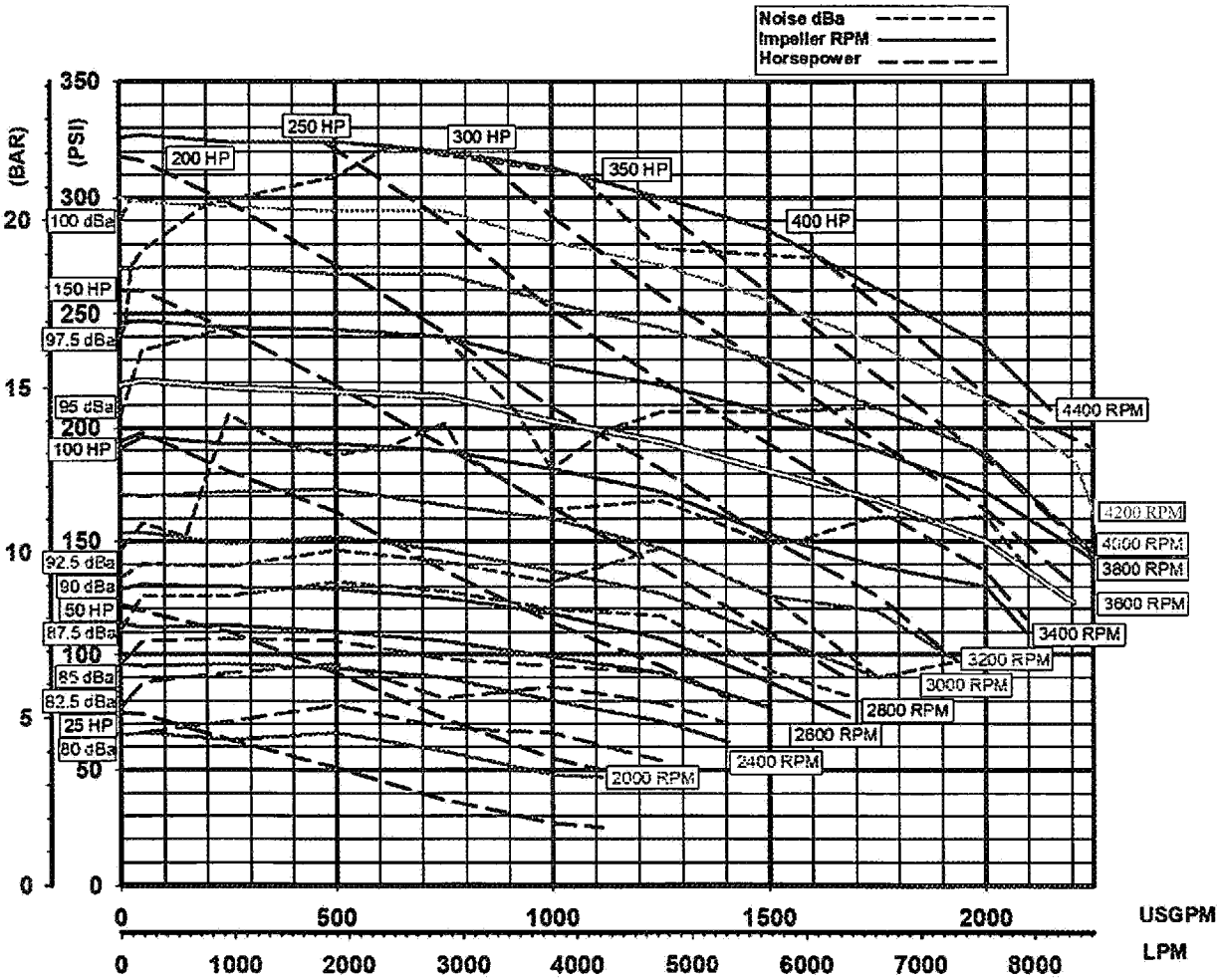
FIG. 14 is a chart pertaining to testing of a pump in accordance with one aspect of the invention.

In a further example, Chart 2 (as shown in FIG. 14) depicts outputs and noise characteristics at various parameters in the testing of a representative pump 20 with casing 22' as shown in FIG. 6. The impeller used in this testing is the same as or similar to the impeller of Example 1. The casing used in the test included the cut-water wall structures as noted in FIG. 6 incorporated into a casing as shown in FIG. 11, i.e., for noise testing purposes the casing 19 of FIG. 11 was modified to include the identical or nearly identical cut-wall features of FIG. 6 (and with the single Example 1 impeller, a double cut water, and a single discharge nozzle). CD1' represents a cut-wall location before modification of casing 19 to have a CD1 corresponding to CD1 of FIG. 6. CD1 was 12.500 inches.

Chart 2 presents various measurements of volume (USGPM/LPM), pressures (PSI/BAR), horsepower (HP), impeller speed (RPM), and Noise (dBa). In operation (the operational range of the pump 20), pump 20 runs in the following ranges: 0-250 PSI up to 1000 GPM, 0-200 PSI up to 1400 GPM, and 0-150 PSI up to 2000 GPM. Measurements below 500 GPM and at operating pressure above 150 PSI are shown in Chart 2 to exceed 90 or 92.5 dBa, which is a significant noise decrease as compared to the noise levels of Chart 1. Comparison of the charts demonstrates significant noise level decreases are achieved throughout the range of operation. The line representing 95 decibels in Chart 2 is shown at levels at the higher end of the normal operational ranges of the pump. Chart 2 shows the pump still achieves desired outputs for the range of operation.

Figure 15:
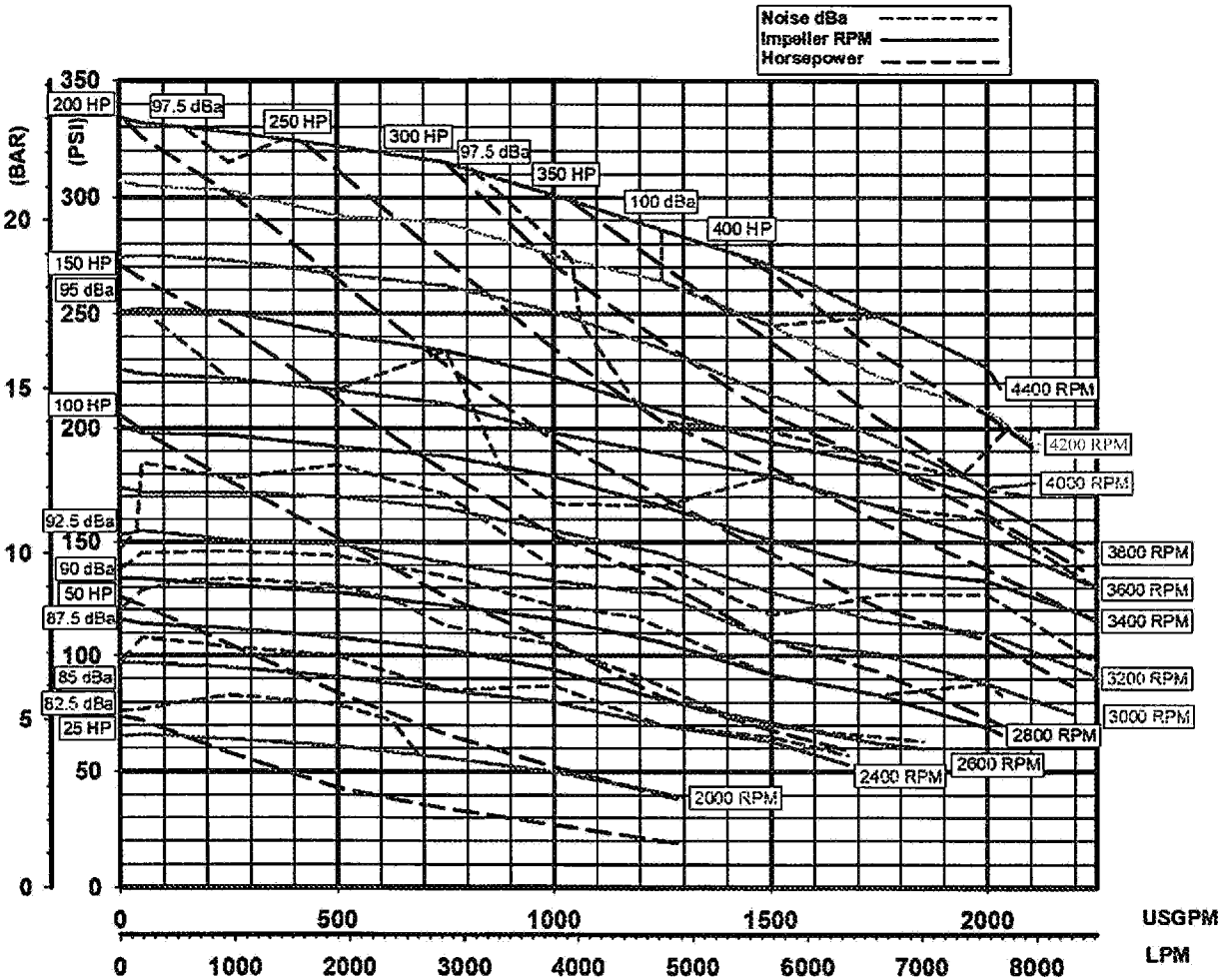
FIG. 15 is a chart pertaining to testing of a pump in accordance with one aspect of the invention.

In a further example, Chart 3 (as shown in FIG. 15) depicts outputs and noise characteristics at various parameters in the testing of a representative pump 20 with casing 22" as shown in FIG. 7 and FIG. 8. The impeller used in this testing is the same as or similar to the impeller of Example 1. A revised casting was made for this ductile iron pump casing 22" to have those features shown in FIG. 7.

Chart 3 presents various measurements of volume (USGPM/LPM), pressures (PSI/BAR), horsepower (HP), impeller speed (RPM), and Noise (dBa). In operation (the operational range of the pump 20), pump 20 runs in the following ranges: 0-250 PSI up to 1000 GPM, 0-200 PSI up to 1400 GPM, and 0-150 PSI up to 2000 GPM. Measurements below 500 GPM and at operating pressure above 150 PSI are shown in Chart 3 to exceed 90 or 92.5 dBa, which is a significant noise decrease as compared to the noise levels of Chart 1 and Chart 2. Comparison of the charts demonstrates significant noise level decreases are achieved throughout the range of operation. The line representing 95 decibels in Chart 3 is shown at levels at the higher end of the normal operational ranges of the pump. Chart 3 shows the pump still achieves desired outputs for the range of operation.

While the present invention has been described with reference to several particular example embodiments, those skilled in the art will recognize that many changes may be made thereto without departing from the spirit and scope of the present invention, which is set forth in the following claims.

What is claimed is:

1. A single piece pump casing for use with a centrifugal pump to provide low noise characteristics, the casing comprising:

a first cut-water fluid flow path defined at least in part by a first cut-water wall, a second cut-water fluid flow path defined at least in part by a second cut-water wall, a first joint-water path and a second joint-water path, the first cut-water fluid flow path and the second cut-water fluid flow path communicating with the first joint-water path and the second joint-water path, the first joint-water path communicating with a first discharge nozzle and the second joint-water path communicating with a second discharge nozzle, the second cut-water wall having a total span of less than 180 degrees from a leading edge of the second cut-water wall to a trailing edge of the second cut-water wall as measured from a center point of a center opening of the casing and providing the low noise characteristics, the center opening configured to receive a drive shaft.

2. The pump casing of claim 1, where a leading end of the first cut-water wall is positioned in a spaced relation with respect to a horizontal centerline running through a center point of a center opening passing through the casing.

3. The pump casing of claim 1, where the first discharge nozzle and the second discharge nozzle are situated at opposing ends of the casing, the first discharge nozzle defining a first center output point and the second discharge nozzle defining a second center output point, the first center output point and the second center output point defining a line offset from the center point of the center opening passing through the casing.

4. The pump casing of claim 1, where a leading end of the first cut-water wall is positioned at or near the line.

5. The pump casing of claim 1, where a trailing end of the second cut-water wall is positioned at or near a horizontal centerline running through the center point of the center opening passing through the casing.

6. A centrifugal pump comprising the pump casing of claim 1 and an impeller having an impeller diameter, the first cut-water wall and the second cut-water wall defining a cutwater diameter passing through the center point of the center opening of the casing, the cutwater diameter being greater than 1.07 times the impeller diameter where the specific speed of the impeller is 1500-2500.

7. The pump casing of claim 1, where the first cut-water wall and the second cut-water wall define a diameter passing through the center point of the center opening of the casing, the diameter having a constant measure from a lead end of the first cut-water wall toward a trailing end of the first cut-water wall.

8. The pump casing of claim 7, where the diameter has a varying measure from a trailing end of the second cut-water wall toward a lead end of the second cut-water wall.

9. The casing of claim 8, where the diameter is constant for at least one inch from the lead end of the first cut-water wall toward the trailing end of the first cut-water wall.

10. The casing of claim 7, where, from a lead end of the second cut-water wall to a trailing end of the second cut-water wall, the diameter transitions from having a constant measure to having a varying measure.

11. A single piece pump casing comprising:

a first cut-water fluid flow path defined at least in part by a first cut-water wall, a second cut-water fluid flow path defined at least in part by a second cut-water wall, a first joint-water path and a second joint-water path, the first cut-water fluid flow path and the second cut-water fluid flow path communicating with the first joint-water path and the second joint-water path, the first joint-water path communicating with a first discharge nozzle and the second joint-water path communicating with a second discharge nozzle, the first discharge nozzle and the second discharge nozzle situated substantially at opposing ends of the casing, the first discharge nozzle defining a first center output point and the second discharge nozzle defining a second center output point, the first center output point and the second center output point defining a line, a closest point of the line offset, in a first direction, from a center point of a center opening passing through the casing, a leading end of the first cut-water wall positioned in a spaced relation, in the first direction, from a horizontal centerline running through the center point.

12. A pump comprising the pump casing of claim 11 and an impeller having an impeller diameter, the first cut-water wall and the second cut-water wall defining a cutwater diameter passing through the center point of the center opening of the casing, the cutwater diameter being greater than 1.07 times the impeller diameter.

13. The pump casing of claim 11, where the first cut-water wall and the second cut-water wall define a diameter passing through the center point of the center opening of the casing and where, from a lead end of the second cut-water wall to a trailing end of the second cut-water wall, the diameter transitions from having a constant measure to having a varying measure.

14. A pump, comprising:

a single piece pump casing comprising an impeller contained within the pump casing, the impeller having a diameter, the casing further comprising:

a first cut-water fluid flow path defined at least in part by a first cut-water wall, a second cut-water fluid flow path defined at least in part by a second cut-water wall, a first joint-water path and a second joint-water path, the first cut-water fluid flow path and the second cut-water fluid flow path communicating with the first joint-water path and the second joint-water path, the first joint-water path communicating with a first discharge nozzle and the second joint-water path communicating with a second discharge nozzle, the first cut-water wall and the second cut-water wall defining a cutwater diameter passing through a center point of a center opening of the casing, the cutwater diameter, as measured between a first cut-water of the first cut-water wall and a second cut-water of the second cut-water wall, configured to be greater than 1.07 times the impeller diameter and such that when the pump operates below 500 GPM at operating pressure above 150 PSI, noise of the pump is less than 95 dBa.

15. The pump of claim 14, where the impeller has a diameter of at least 10.969 inches.

16. The pump of claim 14, where the cutwater diameter is at least 1.16 times the impeller diameter.

17. The pump of claim 16, where the first discharge nozzle defines a first center output point and the second discharge nozzle defines a second center output point, the first center output point and the second center output point defining a line offset from the center point of the center opening passing through the casing.

18. The pump of claim 14, where the second cut-water wall has a total span of less than 180 degrees from a leading edge of the second cut-water wall to a trailing edge of the second cut-water wall as measured from the center point of the center opening of the casing, the center opening configured to receive a drive shaft.

19. The pump of claim 14, where, from a lead end of the second cut-water wall toward a trailing end of the second cut-water wall, the cutwater diameter transitions from having a constant measure to having a varying measure.

20. A single piece pump casing for use with a centrifugal pump, the casing comprising:

a first cut-water fluid flow path defined at least in part by a first cut-water wall, a second cut-water fluid flow path defined at least in part by a second cut-water wall, a first joint-water path and a second joint-water path, the first cut-water fluid flow path and the second cut-water fluid flow path communicating with the first joint-water path and the second joint-water path, the first joint-water path communicating with a first discharge nozzle and the second joint-water path communicating with a second discharge nozzle, the first cut-water wall and the second cut-water wall defining a cutwater diameter passing through a center point of a center opening of the casing, the cutwater diameter having a constant measure from a lead end of the first cut-water wall toward a trailing end of the first cut-water wall, the second cut-water wall having a span of less than 180 degrees from a leading edge of the second cut-water wall to a trailing edge of the second cut-water wall as measured from the center point.

21. The casing of claim 20, where the diameter is constant for at least one inch from the lead end toward the trailing end.

22. The casing of claim 20, where the diameter is constant for a range of 33 degrees along the first cut-water wall as measured from the center point of the center opening of the casing, the center opening configured to receive a drive shaft.

23. The casing of claim 20, where, from a lead end of the second cut-water wall toward a trailing end of the second cut-water wall, the diameter transitions from having a constant measure to having a varying measure.

24. The casing of claim 23, where the transition occurs at a position less than or equal to 3.6 inches from the lead end of the second cut-water wall.

25. The casing of claim 20, where the diameter has a varying measure from a trailing end of the second cut-water wall toward a lead end of the second cut-water wall.

26. The casing of claim 20, where the casing is configured to receive an impeller having an impeller diameter, the cutwater diameter being greater than 1.07 times the impeller diameter.

27. The pump of claim 14 where the impeller diameter is configured has a diameter such that the pump produces less than 95 decibels when the pump is run above 150 psi and below 500 gallons per minute.

28. The pump of claim 14, such that the pump produces less than 95 decibels when the pump is run above 150 psi and below 300 gallons per minute.

29. The casing of claim 20, where the diameter is constant beginning at the lead end of the first cutwater wall to a range of between one inch from the lead end and less than 33 degrees from the lead end along the first cut-water wall.

30. A centrifugal pump comprising the pump casing of claim 20 and an impeller, the cutwater diameter having a varying measure from a trailing end of the second cut-water wall toward a lead end of the second cut-water wall.

31. A centrifugal pump comprising the pump casing of claim 1 and an impeller positioned within the casing.

32. A centrifugal pump comprising the pump casing of claim 20 and an impeller positioned within the casing, the pump configured to provide low noise characteristics.

* * * * *